US006894596B2

(12) United States Patent
Suzuki

(10) Patent No.: US 6,894,596 B2
(45) Date of Patent: May 17, 2005

(54) INVERTER TRANSFORMER TO LIGHT MULTIPLE LAMPS

(75) Inventor: Shinichi Suzuki, Iwata-gun (JP)

(73) Assignee: Minebea Co., Ltd., Kitasaku-gun (JP)

( * ) Notice: Subject to any disclaimer, the term of this patent is extended or adjusted under 35 U.S.C. 154(b) by 5 days.

(21) Appl. No.: 10/701,484

(22) Filed: Nov. 6, 2003

(65) Prior Publication Data

US 2004/0130426 A1 Jul. 8, 2004

(30) Foreign Application Priority Data

Jan. 7, 2003 (JP) ..... 2003-001083

(51) Int. Cl.[7] ..... H01F 27/02

(52) U.S. Cl. ..... 336/83; 336/198; 336/200; 336/212; 323/250

(58) Field of Search ..... 336/83, 170, 180–184, 336/198, 200, 212, 214, 215, 221; 323/250–251; 363/153

(56) References Cited

U.S. PATENT DOCUMENTS 5,177,460 A * 1/1993 Dhyanchand et al. ..... 336/12
6,201,463 B1 * 3/2001 Yamashita et al. ..... 336/198
6,424,247 B2 * 7/2002 Suzuki ..... 336/110
6,611,190 B2 * 8/2003 Chui et al. ..... 336/198
6,714,111 B2 * 3/2004 Suzuki ..... 336/110

FOREIGN PATENT DOCUMENTS

JP 07-220945 * 8/1995
JP 2002-043148 * 2/2002

* cited by examiner

*Primary Examiner*—Tuyen T. Nguyen
(74) *Attorney, Agent, or Firm*—Oliff & Berridge, PLC

(57) ABSTRACT

An inverter transformer includes: a frame-core shaped substantially square; a plurality of I-cores disposed inside and coupled to the frame-core so as to provide a predetermined leakage inductance; and a plurality of primary and secondary windings provided respectively around the I-cores. The I-cores are divided into first group cores located not adjacent to one another and second group cores located not adjacent to one another but adjacent respectively to the first group cores. Magnetic fluxes generated in the first group cores flow in the same direction, magnetic fluxes generated in the second group cores flow in the same direction that is opposite to the direction of the magnetic fluxes generated in the first group cores, and respective voltages induced at secondary windings provided respectively around the first and second group cores are polarized identical with each other.

15 Claims, 8 Drawing Sheets

| No. | Input | With No Loads | | | With Loads | | |
|---|---|---|---|---|---|---|---|
| | | Output Voltage:Vop[Vrms] | | | Output Current:IL[mArms] | | |
| | | Circuit A | Circuit B | Circuit C | Circuit A | Circuit B | Circui C |
| 1 | Only A | 1652 | 0 | 180 | 9.80 | 0 | 0 |
| 2 | Only B | 0 | 1628 | 0 | 0 | 11.40 | 0 |
| 3 | Only C | 192 | 0 | 1574 | 0 | 0 | 10.00 |
| 4 | A&B | 1838 | 1834 | 186 | 6.85 | 9.15 | 0 |
| 5 | A&C | 1618 | 70 | 1556 | 9.00 | 0 | 9.20 |
| 6 | B&C | 183 | 1834 | 1780 | 0 | 9.10 | 7.00 |
| 7 | A&B&C | 1800 | 1972 | 1752 | 6.95 | 7.05 | 7.10 |

INVERTER TRANSFORMER TO LIGHT MULTIPLE LAMPS

BACKGROUND OF THE INVENTION

1. Field of the Invention

The present invention relates to an inverter transformer, and more particularly to an inverter transformer adapted to gain a high voltage by means of leakage inductance.

2. Description of the Related Art

In recent years, a liquid crystal display (hereinafter referred to as "LCD") has been widely used as a display device for a personal computer or the like, replacing a cathode ray tube, what we call "CRT". Unlike the CRT, the LCD does not emit light by itself, and therefore requires a lighting apparatus for lighting a screen, such as backlight or frontlight system. Cold-cathode fluorescent lamps (hereinafter referred to as "CCFL") are generally used as light sources for the system and simultaneously discharged and lighted.

For lighting and discharging the CCFLs, an inverter circuit is generally employed, which generates a high-frequency voltage of about 60 kHz and about 1600 V at the start of discharging. The inverter circuit, after the discharge of CCFLs, steps down its secondary side voltage to about 600 V, which is necessary to keep CCFLs discharging. Up to now, the inverter transformer for use in the inverter circuit has been available in two types; that is, an open magnetic circuit structure using an I-core as a magnetic core, and a closed magnetic circuit structure.

With the open magnetic circuit structure, since the number of the inverter transformer increases with an increase of the number of the CCFLs by one-to-one ratio, the inverter transformer is increased in size as a whole, and the cost is pushed up. And, with the closed magnetic circuit structure, although a plurality of CCFLs can be discharged by one inverter transformer, variation in the discharging operation occurs between the CCFLs, and also the inverter transformer is damaged by excess current. The problem of the variation in the discharging operation between the CCFLs can be solved by inserting a ballast capacitor in series between the CCFLs, but this decreases power efficiency and increases variation in the CCFL current. Furthermore, this results in an increased number of components and increased cost of production.

A conventional inverter transformer intended to solve these problems is disclosed in, for example, Japanese Patent Application Laid-Open No. 2002-353044. FIG. 8 shows such an inverter transformer 20, which comprises a magnetic core 21 consisting of a substantially rectangular frame-core 22 (hereinafter referred to as "frame-core") and two I-shaped inner cores 23*a*, 23*b* (hereinafter referred to as I-core). The inverter transformer 20 further comprises a primary winding 24, two secondary windings 25*a*, 25*b*, and two bobbins 26*a*, 26*b* which are of tubular structure with a rectangular cross section, and which have therearound the aforementioned two secondary windings 25*a*, 25*b*, respectively, and the aforementioned primary winding 24 provided corresponding to the two secondary windings 25*a*, 25*b* in common. Magnetic flux, which is generated by causing current to flow through the primary winding 24, flows through the I-cores 23*a*, 23*b* in the same direction thus forming two separate magnetic fluxes flowing respectively into two opposing sides 22*a*, 22*b* (magnetic paths) of the frame-core 22 without interfering each other, thereby enabling two CCFLs to be driven at the same time.

Thus, the inverter transformer, while having only one primary winding, has a plurality (two in the figure) of independent secondary windings sharing the one primary winding, and therefore two CCFLs can be lighted at the same time without installing two inverter transformers or two ballast capacitors as have been required conventionally. However, the following problem is associated with the inverter transformer. That is, in recent years the LCD of side edge type uses as many as six lamps, with three CCFLs disposed at its upper side and another three CCFLs disposed at its lower side. In this case, three of the inverter transformers discussed above are required in order to light the six CCFLs. This invites a cost increase, and also prevents downsizing of the apparatus.

SUMMARY OF THE INVENTION

The present invention has been made in light of the circumstances, and it is an object of the present invention to provide a small-size, low-cost multiple lamp inverter transformer.

In order to achieve the above object, according to one aspect of the present invention, an inverter transformer includes: a frame-core shaped substantially square; a plurality of I-cores disposed inside and coupled to the frame-core so as to provide a predetermined leakage inductance; and primary and secondary windings. A plurality of primary windings are provided respectively around the plurality of I-cores so as to correspond to a plurality of secondary windings provided respectively around the I-cores. The I-cores are divided into first group cores located not adjacent to one another and second group cores located not adjacent to one another but adjacent respectively to the first group cores. Magnetic fluxes generated in the first group cores by currents flowing in primary windings provided around the first group cores flow in the same direction, magnetic fluxes generated in the second group cores by currents flowing in primary windings provided around the second group cores flow in the same direction that is opposite to the direction of the magnetic fluxes generated in the first group cores, and respective voltages induced at respective secondary windings provided around the first and second group cores are polarized identical with each other.

In the aspect of the present invention, the respective secondary windings provided around the first and second group cores may be wound in opposite directions to each other, and voltages may be applied to respective primary windings provided around the first and second group cores such that the respective voltages induced at the respective secondary windings provided around the first and second group cores are polarized identical with each other.

In the aspect of the present invention, the respective primary windings provided around the first and second group cores may be wound in the same direction, and respective voltages applied to the respective primary windings may be polarized opposite to each other.

In the aspect of the present invention, the respective primary windings provided around the first and second group cores may be wound in opposite directions to each other, and respective voltages applied to the respective primary windings may be polarized identical with each other.

In the aspect of the present invention, the inverter transformer may include at least three of the I-cores.

In the aspect of the present invention, the I-cores may have a cross sectional area equal to one another, and sides of the frame-core, to which the I-cores are disposed parallel, may each have a cross sectional area smaller than a cross sectional area of each of the I-cores.

The inverter transformer of the present invention is capable of lighting a plurality of CCFLs at the same time. Also, voltages induced at the secondary windings are polarized identical with one another, and are evened up therebetween thus allowing the withstand voltage to be kept low. Consequently, the number of components is decreased resulting in a downsizing and cost reduction of the apparatus.

BRIEF DESCRIPTION OF THE DRAWINGS

The above object and other advantages of the present invention will become more apparent by describing in detail the preferred embodiment of the present invention with reference to the attached drawings in which:

FIGS. 1A to 1C are diagrams of an inverter transformer according to a first embodiment of the present inventions, wherein FIG. 1A shows cores, windings and magnetic fluxes, and FIGS. 1B and 1C show polarities of the windings and applied voltages;

FIGS. 2A and 2B are diagrams of an inverter transformer according to a second embodiment of the present invention, wherein FIG. 2A shows cores, windings and magnetic fluxes, and FIG. 2B shows polarities of the windings and applied voltages;

DETAILED DESCRIPTION OF THE PREFERRED EMBODIMENTS

Preferred embodiments of the present invention will be described with reference to the accompanying drawings.

Figure 1A:
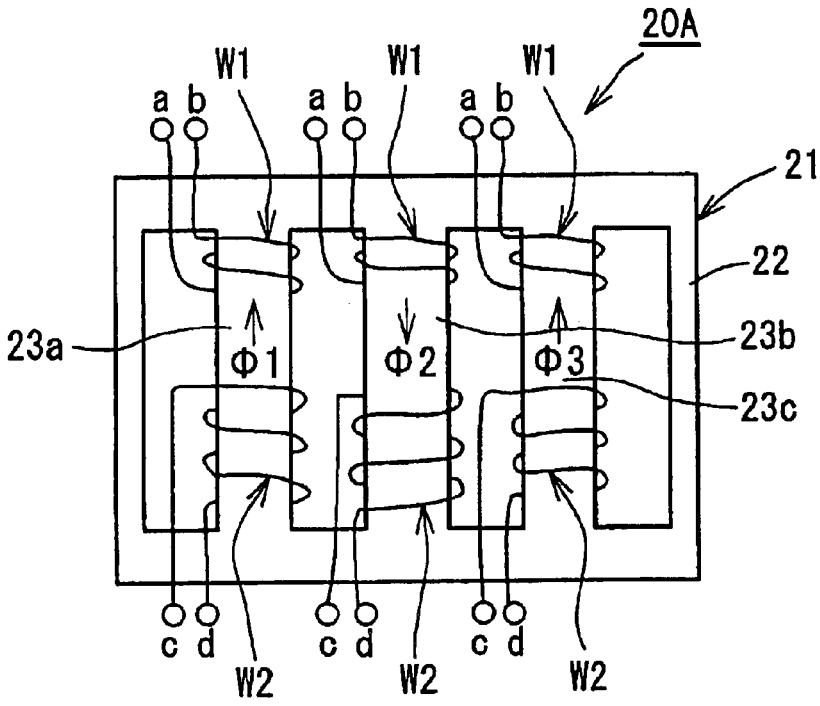

A first embodiment of the present invention will hereinafter be described with reference to FIGS. 1A to 1C. An inverter transformer 20A is adapted to light three CCFLs and comprises a magnetic core 21 consisting of a frame-core 22 shaped substantially rectangular and three I-cores 23*a*, 23*b* and 23*c* disposed inside and coupled to the frame-core 22 so as to provide a predetermined leakage inductance. The I-cores 23*a*, 23*b* and 23*c* have respective primary and secondary windings W1 and W2 provided therearound.

Currents, which flow in two primary windings W1 provided respectively around the I-cores 23*a* and 23*c* (hereinafter referred to as first group as appropriate) located not adjacent to each other, generate respective magnetic fluxes Φ1 and Φ3 flowing in the same direction. The magnetic fluxes Φ1 and Φ3 generated by the two primary winding W1 of the first group and a magnetic flux Φ2, which is generated by current flowing in a primary winding W1 provided around the I-core 23*b* (hereinafter referred to as second group as appropriate), flow in opposite directions to each other.

The primary windings W1 to generate the magnetic fluxes Φ1, Φ2 and Φ3 may be arranged in two ways. Specifically, one is such that the primary windings W1 of both the first and second groups are all wound in the same direction and their applied voltages "e" are polarized reverse between the first and second groups as shown in FIG. 1B, and the other is such that the primary windings W1 of the first group and the primary winding W1 of the second group are wound in opposite directions to each other and their applied voltages "e" are polarized identical with each other as shown in FIG. 1C. In each of the two arrangements, the magnetic flux Φ2, which is generated in the I-core 23*b* of the second group located between the two I-cores 23*a* and 23*c* of the first group, flows in an opposite direction to the magnetic fluxes Φ1 and Φ3 generated in the I-cores 23*a* and 23*c* of the first group.

If the magnetic fluxes Φ1, Φ2 and Φ3 are generated so as to flow in the directions as described above, then voltages, which are induced respectively by the magnetic fluxes Φ1 and Φ3 between terminals c and d of two secondary windings W2 of the first group provided around the I-cores 23*a* and 23*c*, are polarized identical with each other while a voltage, which is induced by the magnetic flux Φ2 between terminals c and d of the secondary winding W2 of the second group provided around the I-core 23*b*, has, despite the magnetic flux Φ2 flowing in an opposite direction to the magnetic fluxes Φ1 and Φ3, the same polarity as the voltages induced at the secondary windings W2 of the first group because the secondary winding W2 of the second group is wound in an opposite direction to the secondary windings W2 of the first group.

Figure 1B:
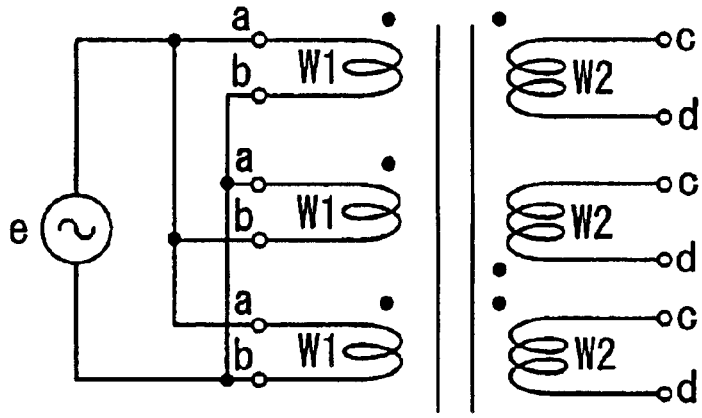
Figure 1C:
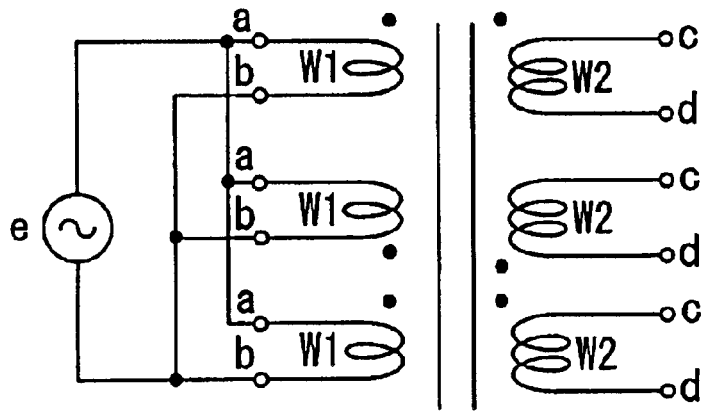

The primary windings W1 shown in FIGS. 1B and 1C are connected to one another in parallel, but may alternatively be connected in series. In case of series connection, the winding direction of the primary windings W1 and the polarity of the applied voltage are set so as to cause respective magnetic fluxes to be generated in the same way as in the parallel connection discussed above.

As mentioned above, the secondary windings of the inverter transformer must be provided with a high-frequency voltage of about 1600 V to light a CCFL, and a high-frequency voltage of about 600 V to keep CCFL discharging. But, when the winding direction of the primary windings and the secondary windings and the polarity of the applied voltage of the primary windings are set appropriately as above described, voltages induced at the secondary windings are polarized identical with one another, which evens up voltages applied between the secondary windings thus allowing the withstand voltage of the inverter transformer to be low. Also, the inverter transformer can light three CCFLs at the same time, which results in a decreased number of components, and a downsizing and reduced cost of the apparatus.

Figure 2A:
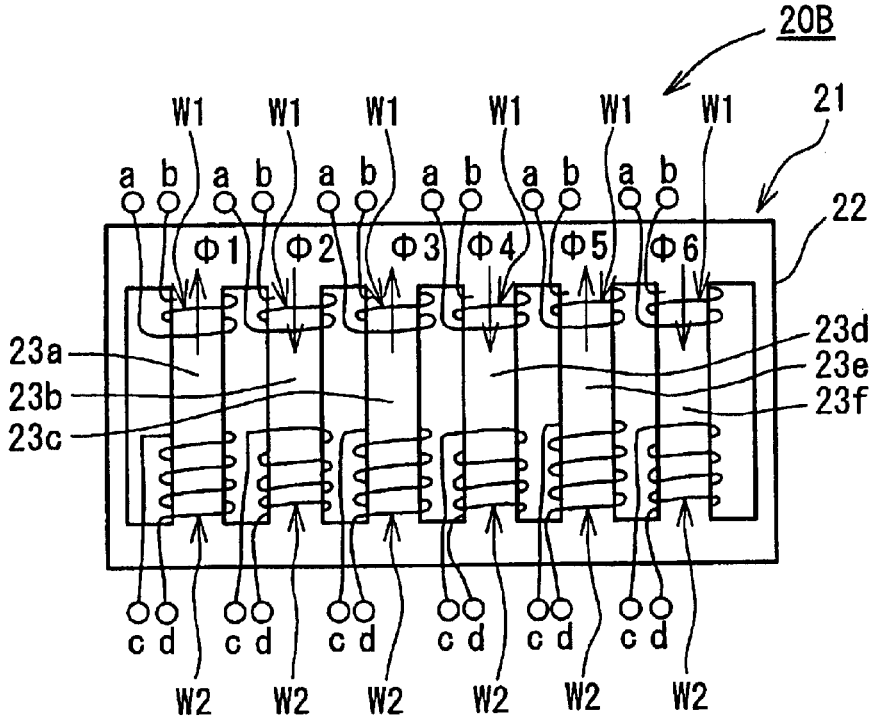

A second embodiment of the present invention will now be described with reference to FIGS. 2A and 2B. An inverter transformer 20B is adapted to light six CCFLs and comprises a magnetic core 21 consisting of a frame-core 22 shaped substantially rectangular and six I-cores 23*a*, 23*b*, 23*c*, 23*d*, 23*e* and 23*f* disposed inside and coupled to the frame-core 22 so as to provide a predetermined leakage inductance. The I-cores 23*a*, 23*b*, 23*c*, 23*d*, 23*e* and 23*f* have respective primary and secondary windings W1 and W2 provided therearound.

Currents, which flow in three primary windings W1 provided respectively around three I-cores 23*a*, 23*c*, 23*e* (hereinafter referred to as first group as appropriate) located not adjacent to one another, generate respective magnetic fluxes Φ1, Φ3 and Φ5 flowing in the same direction. Currents, which flow in another three primary windings W1 provided respectively around three I-cores 23*b*, 23*d*, 23*f* (hereinafter referred to as second group as appropriate) located not adjacent to one another but adjacent respectively to the I-cores 23*a*, 23*c* and 23*e* of the first group, generate respective magnetic fluxes Φ2, Φ4 and Φ6 flowing in the same direction. And, the magnetic fluxes Φ1, Φ3 and Φ5 generated by the primary windings W1 of the first group and the magnetic fluxes Φ2, Φ4 and Φ6 generated by the primary windings W1 of the second group flow in opposite directions to each other.

The primary windings W1 to generate the magnetic fluxes Φ1, Φ2, Φ3, Φ4, Φ5 and Φ6 may be arranged in two ways like in the first embodiment as described with reference to FIGS. 1B and 1C. Specifically, one is such that the primary windings W1 of both the first and second groups are all wound in the same direction and their applied voltages "e" are polarized reverse between the first and second groups as shown in FIG. 2B, and the other is such that the primary windings W1 of the first group and the primary windings W1 of the second group are wound in opposite directions to each other and their respective applied voltages "e" are polarized identical with each other (not shown). In each of the two arrangements, the magnetic fluxes Φ2, Φ4 and Φ6, which are generated in the I-cores 23*b*, 23*d*, 23*f* of the second group located adjacent respectively to the I-cores 23*a*, 23*c* and 23*e* of the first group, flow in an opposite direction to the magnetic fluxes Φ1, Φ3 and Φ5 generated in the I-cores 23*a*, 23*c* and 23*e* of the first group.

If the magnetic fluxes Φ1, Φ2, Φ3, Φ4, Φ5 and Φ6 are generated so as to flow in the directions as described above, then voltages, which are induced respectively by the magnetic fluxes Φ1, Φ3 and Φ5 between terminals c and d of three secondary windings W2 of the first group provided around the I-cores 23*a*, 23*c* and 23*e*, are polarized identical with one another while voltages, which are induced respectively by the magnetic fluxes Φ2, Φ4 and Φ6 between terminals c and d of another three secondary windings W2 of the second group provided around the I-cores 23*b*, 23*d*, 23*f*, are polarized identical with one another, and at the same time have, despite the magnetic fluxes Φ2, Φ4 and Φ6 flowing in an opposite direction to the magnetic fluxes Φ1, Φ3 and Φ5, the same polarity as the voltages induced at the secondary windings W2 of the first group because the secondary windings W2 of the second group are wound in an opposite direction to the secondary windings W2 of the first group.

Figure 2B:
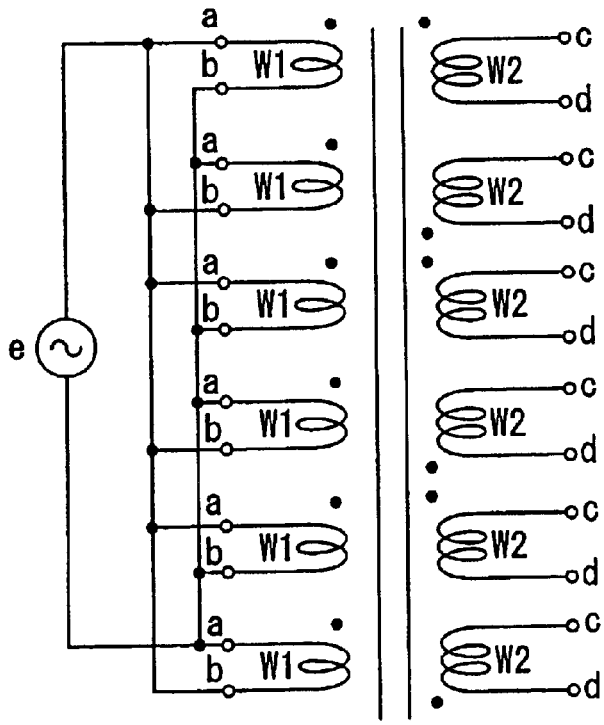

The primary windings W1 shown in FIG. 2B are connected to one another in parallel, but may alternatively be connected in series. In case of series connection, the winding direction of the primary windings W1 and the polarity of the applied voltage are set so as to cause respective magnetic fluxes to be generated in the same way as in the parallel connection discussed above.

In the first and second embodiments discussed above, the inverter transformers 1A and 1B respectively have three and six I-cores disposed inside and coupled to the frame-core 22 so as to provide a predetermined leakage inductance. The number of the I-cores is not limited to three or six, but may alternatively be three or more as long as the following is satisfied: magnetic fluxes, which are generated by the primary windings provided around the first group I-cores located not adjacent to one another, flow in the same direction; magnetic fluxes, which are generated by the primary windings provided around the second group I-cores located not adjacent to one another but adjacent respectively to the first group I-cores, flow in the same direction and flow in an opposite direction to the magnetic fluxes of the first group; and voltages, which are induced at respective secondary windings provided around the first and second group I-cores, are polarized identical with each other.

Figure 3:
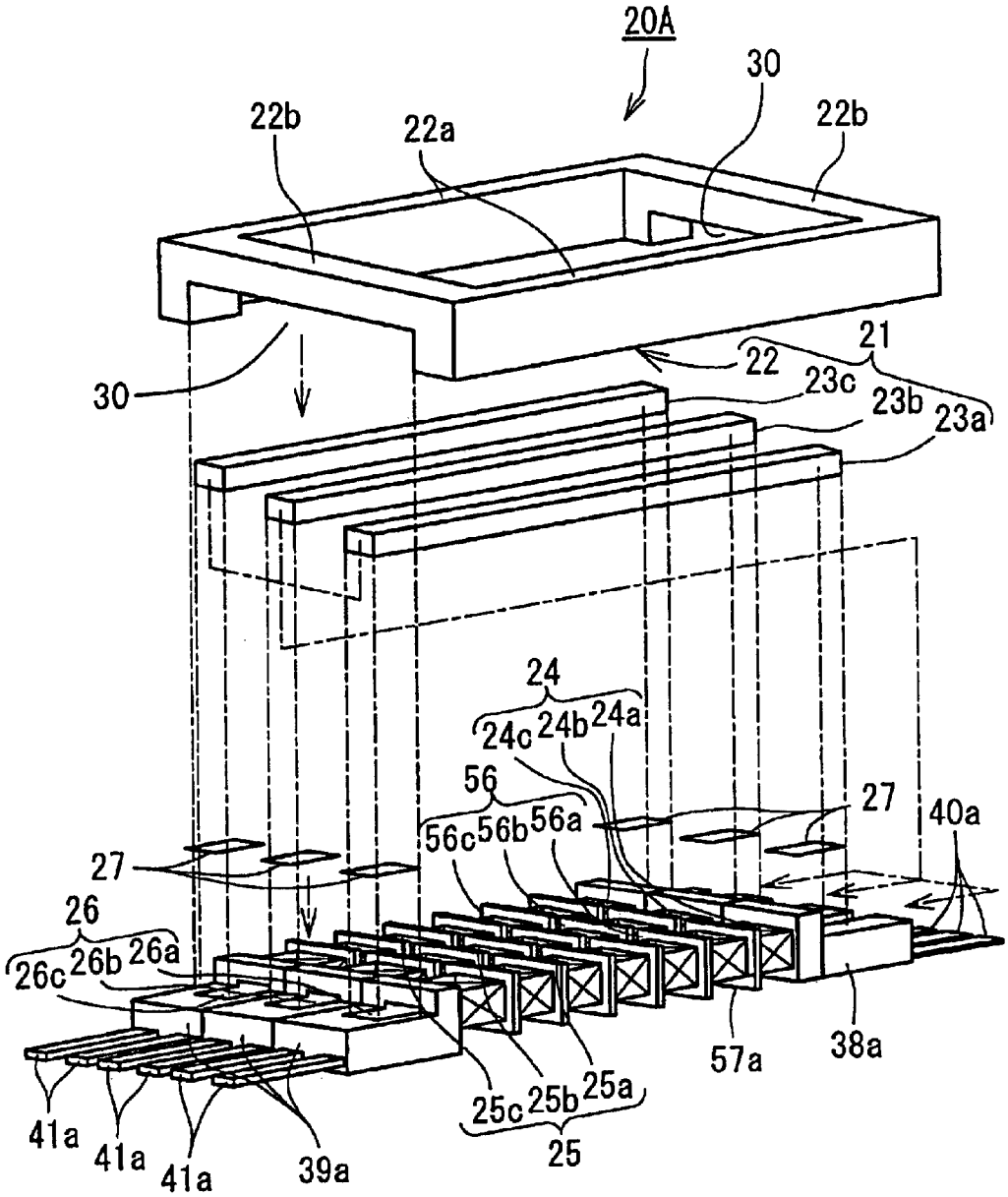
FIG. 3 is an exploded perspective view of the inverter transformer according to the first embodiment of the present invention.
Figure 4:
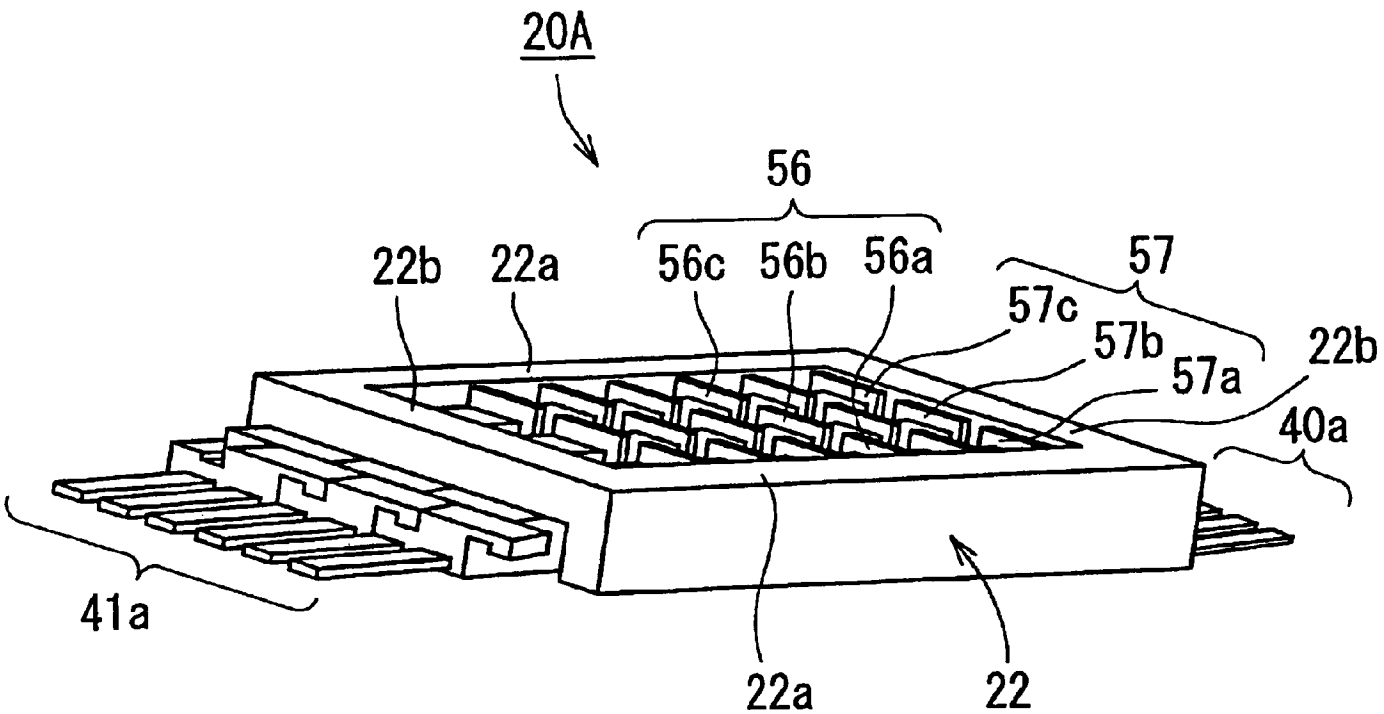
FIG. 4 is a perspective view of the inverter transformer according to the first embodiment of the present invention.
Figure 5:
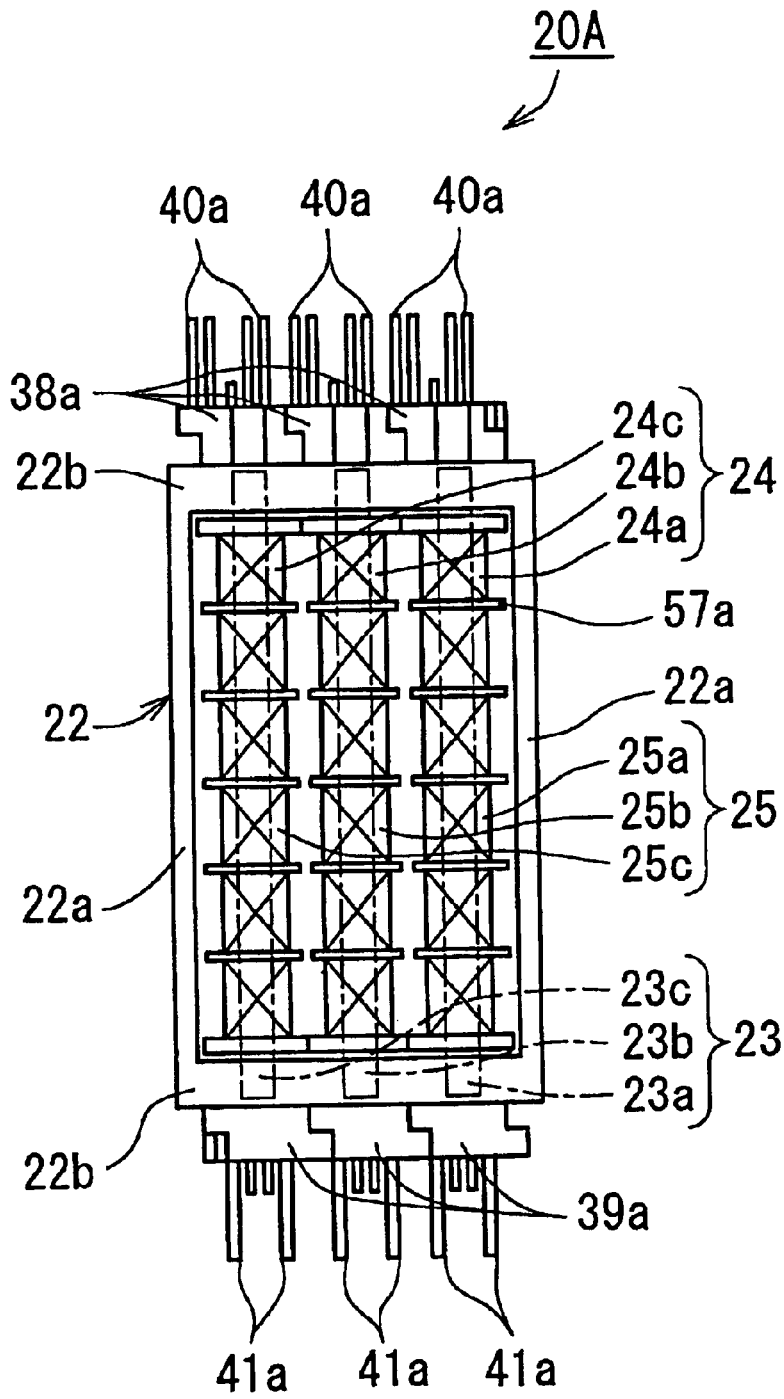
FIG. 5 is a plan view of the inverter transformer according to the first embodiment of the present invention.

Structure of the inverter transformer according to the first embodiment will hereinafter be described with reference to FIGS. 3 to 5. The windings in FIGS. 3 to 5 can be polarized in the same way as described with reference to FIG. 1, and an explanation thereof is omitted. Referring to FIG. 3, an inverter transformer 20A generally comprises: a magnetic core 21 consisting of a substantially rectangular frame-core 22 and three I-cores 23 (23*a*, 23*b* and 23*c*); three primary windings 24 (24*a*, 24*b* and 24*c*, referred to as W1 in FIGS. 1A to 1B); three secondary windings 25 (25*a*, 25*b* and 25*c*, referred to as W2 in FIGS. 1A to 1B); and three rectangular tubular bobbin 26 (26*a*, 26*b* and 26*c*) configured identical with one another and adapted to have respective I cores 23 provided therein and respective primary and secondary windings 24 and 25 provided therearound.

The inverter transformer 20A is assembled such that the I-cores 23 are inserted into respective bobbins 26, a nonmagnetic sheet 27 is placed on the upper face of each of the I-cores 23, and then the frame-core 22 is placed. The frame-core 22 has two longer sides 22*a* and two shorter sides 22*b* both shaped like a quadratic prism. The I-cores 23 are disposed parallel to the longer sides 22*a*, positioned electromagnetically equivalent to one another and fixedly coupled to the frame-core 22 via the nonmagnetic sheets 27 so that the primary windings 24 and the secondary windings 25 can be magnetically coupled to each other so as to provide uniform characteristics and a predetermined leakage inductance.

As described above, the three I-cores 23 are coupled to the frame-core 22 via the nonmagnetic sheets 27 so as to provide a predetermined leakage inductance. The shorter sides 22*b* of the frame-core 22 each define a vacancy 30 at one face thereof, and a first terminal block 38*a* provided at the primary winding side and a second terminal block 39*a* provided at the secondary winding side are engagingly fitted into respective vacancies 30. The I-cores 23 have a cross sectional area equal to one another at portions where the primary and secondary winding 24 and 25 are provided, and the longer side 22*a* of the frame-core 22 has a smaller cross sectional area than the I-core 23. This structure is based on that magnetic fluxes flowing in the two longer sides 22*a* are shunted into the three I-cores 23 disposed side by side parallel to the longer sides 22*a*, whereby the amount of the magnetic fluxes flowing in the longer sides 22*a* is reduced to become smaller than the amount of the magnetic fluxes flowing in the I-cores 23 resulting in making a magnetic saturation hard to occur in the longer sides 22*a*. This allows the cross sectional area of the longer sides 22*a* to be reduced thus contributing to downsizing of the inverter transformer.

The first terminal block 38*a* is provided with holes or grooves (either not shown) for passing lead wires (not shown) which connect the primary windings 24 and terminal pins 40*a* attached to the first terminal block 38*a*. The lead wires are covered with an insulator and let through the holes or embedded in the grooves to secure a sufficient creeping distance and insulation. One end of each of the secondary windings 25 is connected to each of the terminal pins 40*a*. The second terminal block 39*a* also is provided with holes or grooves (either not shown) for passing lead wires which connect the secondary windings 25 and terminal pins 41*a* attached to the second terminal block 39*a*. The lead wires are covered with an insulator and let through the holes or embedded in the grooves to secure a sufficient creeping distance and insulation.

The secondary winding 25*a* is wound around the bobbin 26*a* (I-core 23*a*) in an axial direction thereof Since a high voltage is generated at the secondary winding 25*a*, the secondary winding 25*a* is split into a plurality (five in the embodiment of the present invention) of sections in the axial direction and the bobbin 26*a* has four insulation partition plates 56*a* each provided between every two adjacent sections thereby securing a creeping distance adequate to prevent creeping discharge. The insulation partition plates 56*a* are each provided with a notch (not shown) for allowing a wire to pass through, which connects two adjacent sections of the split secondary winding 25*a* sandwiching the insulation partition plate 56*a*. The secondary windings 25*b* and 25*c*, and the bobbin 26*b* and 26*c* are structured in the same way as the secondary winding 25*a* and the bobbin 26*a*.

Further, the bobbin 26*a* has an insulation partition plate 57*a* provided between the primary winding 24*a* and the secondary winding 25*a*. The bobbins 26*b* and 26*c* also have respective insulation partition plates 57*b* and 57*c* provided in the same way.

The inverter transformer according to the second embodiment is structured in the same way as described above except that it includes six, rather than three, I-cores, bobbins, and primary and secondary windings.

Figures 6, 7:
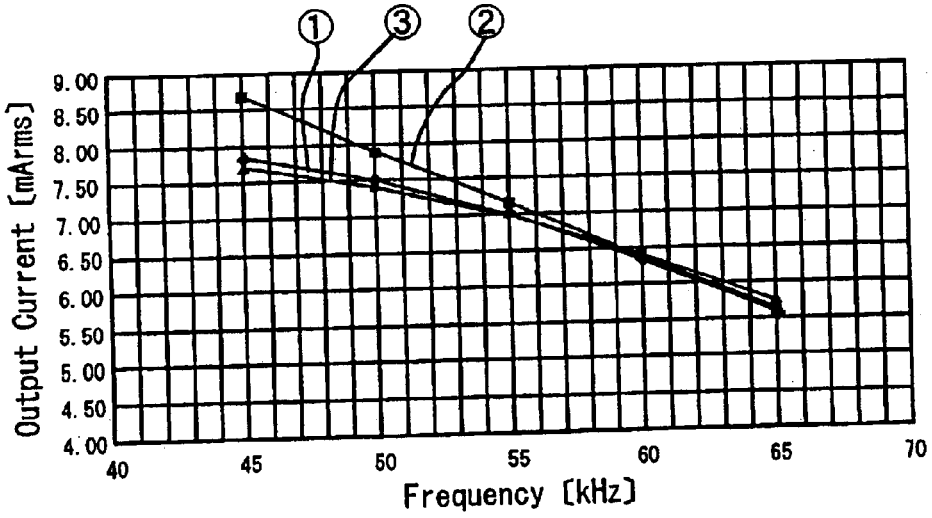
FIG. 6 is a characteristic table of the inverter transformer according to the first embodiment of the present invention, showing variance in output voltage with no load operation and variance in output current with load operation.
FIG. 7 is a characteristic chart of the inverter transformer according to the first embodiment of the present invention, showing variance in output current of lamps 1, 2 and 3 as a function of variance in frequency of applied voltage.
Figure 8:
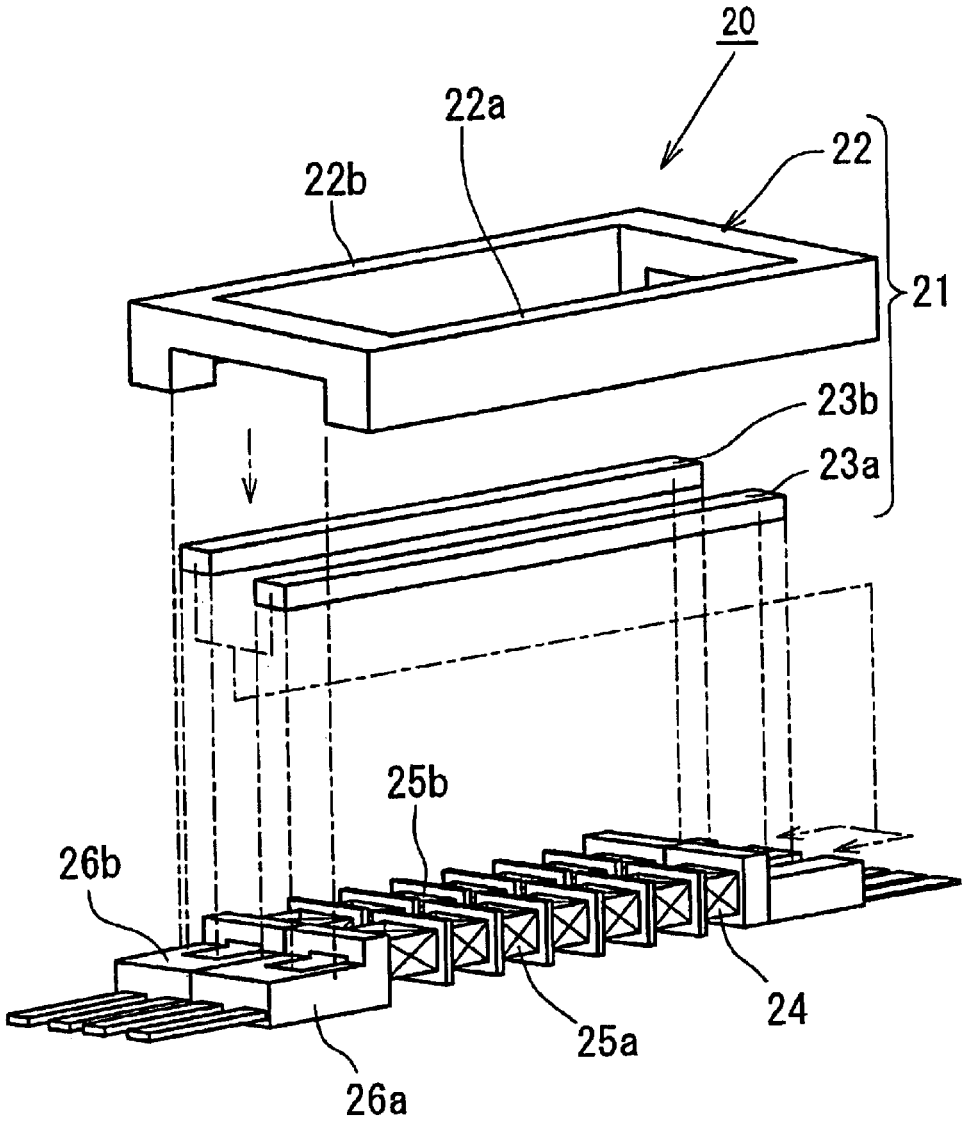
Fig. 8 Prior Art
FIG. 8 is an exploded perspective view of a conventional inverter transformer.

Characteristics of the inverter transformer according to the first embodiment will be explained with reference to FIGS. 6 and 7. The windings in FIGS. 6 and 7 are polarized identically with those shown in FIG. 1B. That is to say, the primary windings W1 (24*a*, 24*b* and 24*c*) provided around the I-cores 23*a*, 23*b* and 23*c* are all wound in the same direction, and the secondary winding W2 (25*b*) provided around the I-core 23*b* is wound in an opposite direction to the secondary windings W2 (25*a* and 25*c*) provided around the I-cores 23*a* and 23*c*. Also, reference symbols A, B and C in FIG. 6 correspond to respective primary and secondary windings W1 (24*a*, 24*b* and 24*c*) and W2 (25*a*, 25*b* and 25*c*) provided around the I-cores 23*a*, 23*b* and 23*c* shown in FIG. 1A. Specifically, Inputs A, B and C are primary voltages applied respectively to the primary windings W1 (24*a*, 24*b* and 24*c*) provided around the I-cores 23*a*, 23*b* and 23*c*, and Circuits A, B and C are secondary voltages induced respectively at the secondary windings W2 (25*a*, 25*b* and 25*c*) provided around the I-cores 23*a*, 23*b* and 23*c*. Loads connected are CCFLs rated identically with one another, and the primary voltage applied to the primary winding W1 (24*b*) provided around the I-core 23*b* is polarized oppositely to the primary voltages applied to the primary windings W1 (24*a* and 24*c*) provided around the I-cores 23*a* and 23*c*. The primary windings W1 (24*a* and 24*c*) around the I-cores 23*a* and 23*c* each have 23 turns, the primary winding W1 (24*b*) around the I-cores 3*b* has 25 turns, and the secondary windings W2 (25*a*, 25*b* and 25*c*) around the I-cores 23*a*, 23*b* and 23*c* each have 2400 turns. Also, a primary voltage of 8.8 V rms with a frequency of 55 kHz is applied to the primary windings W1 (for FIG. 6 only).

Referring to FIG. 6, No. 7 presents variation in output voltage with no loads and output current with loads when the aforementioned voltage is applied to all of the primary windings W1 (24*a*, 24*b* and 24*c*) provided around the I-cores 23*a*, 23*b* and 23*c*. The variation in output voltage with no loads and output current with loads can be reduced, when the magnetic fluxes generated in the I-cores of the first group are caused to flow in the same direction; the magnetic fluxes generated in the I-cores of the second group are caused to flow in the same direction; and the magnetic fluxes of the first group and the magnetic fluxes of the second group are caused to flow in opposite directions to each other.

Nos. 1 to 6 present reference data each showing variation in output voltage with no loads and output current with loads when the aforementioned voltage is applied to one or two of the primary windings W1 (24*a*, 24*b* and 24*c*) provided around the I-cores 23*a*, 23*b* and 23*c*. When no loads are connected, a voltage may occasionally be induced at secondary winding(s) provided around I-core(s) having primary winding(s) to which a voltage is not applied. This happens due to magnetic flux(es) from the other I-core(s) having primary winding(s) to which a voltage is applied. However, since the I-cores are coupled to the frame-core so as to provide a predetermined leakage inductance, an induced voltage necessary for lighting CCFLs is not generated, thus a current is not caused to flow, as seen in FIG. 6

Referring to FIG. 7, when the frequency of the voltage applied to the primary winding changes, variation in currents flowing in lamps ①, ② and ③ is small, which indicates characteristics not much affected by frequency fluctuation, and enhances the product quality. This increases freedom in designing and also in selecting components, thus contributing to cost reduction.

And, as clearly seen in FIGS. 6 and 7, in the inverter transformer 20A according to the first embodiment, the effect described above is achieved when the winding direction of the primary windings W1 (24*a*, 24*b* and 24*c*) provided respectively around the I-cores 23*a*, 23*b* and 23*c* and the polarity of the voltages applied respectively to the primary windings W1 (24*a*, 24*b* and 24*c*) are so arranged as to generate their respective magnetic fluxes Φ1, Φ2 and Φ3 in such a manner that the magnetic fluxes Φ1 and Φ3 (first group) flow in an opposite direction to the magnetic flux Φ2 (second group) while the secondary winding W2 (25*b*) provided around the I-core 23*b* (second group) is wound in an opposite direction to the secondary windings W2 (25*a* and 25*c*) provided around the I-cores 23*a* and 23*c* (first group), which are wound in the same direction.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. An inverter transformer comprising:

a frame-core shaped substantially square;

a plurality of I-cores disposed inside and coupled to the frame-core so as to provide a predetermined leakage inductance, the I-cores being divided into first group cores located not adjacent to one another and second group cores located not adjacent to one another but adjacent respectively to the first group cores;

a plurality of primary windings provided respectively around the I-cores; and a plurality of secondary windings provided respectively around the I-cores, wherein magnetic fluxes generated in the first group cores by currents flowing in primary windings provided around the first group cores flow in a same direction, magnetic fluxes generated in the second group cores by currents flowing in primary windings provided around the second group cores flow in a same direction that is opposite to the direction of the magnetic fluxes generated in the first group cores, and wherein respective voltages induced at respective secondary windings provided around the first and second group core are polarized identical with each other.

2. An inverter transformer according to claim 1, wherein the respective secondary windings provided around the first and second group cores are wound in opposite directions to each other, and voltages are applied to respective primary windings provided around the first and second group cores such that the respective voltages induced at the respective secondary windings provided around the first and second group cores are polarized identical with each other.

3. An inverter transformer according to claim 1, wherein the respective primary windings provided around the first and second group cores are wound in a same direction, and respective voltages applied to the respective primary windings are polarized opposite to each other.

4. An inverter transformer according to claim 1, wherein the respective primary windings provided around the first and second group cores are wound in opposite directions to each other, and respective voltages applied to the respective primary windings are polarized identical with each other.

5. An inverter transformer according to claim 1, including at least three of the I-cores.

6. An inverter transformer according to claim 1, wherein the I-cores have a cross sectional area equal to one another, and sides of the frame-core, to which the I-cores are disposed parallel, each have a cross sectional area smaller than a cross sectional area of each of the I-cores.

7. An inverter transformer according to claim 2, wherein the respective primary windings provided around the first and second group cores are wound in a same direction, and respective voltages applied to the respective primary windings are polarized opposite to each other.

8. An inverter transformer according to claim 2, wherein the respective primary windings provided around the first and second group cores are wound in opposite directions to each other, and respective voltages applied to the respective primary windings are polarized identical with each other.

9. An inverter transformer according to claim 2, including at least three of the I-cores.

10. An inverter transformer according to claim 3, including at least three of the I-cores.

11. An inverter transformer according to claim 4, including at least three of the I-cores.

12. An inverter transformer according to claim 2, wherein the I-cores have a cross sectional area equal to one another, and sides of the frame-core, to which the I-cores are disposed parallel, each have a cross sectional area smaller than a cross sectional area of each of the I-cores.

13. An inverter transformer according to claim 3, wherein the I-cores have a cross sectional area equal to one another, and sides of the frame-core, to which the I-cores are disposed parallel, each have a cross sectional area smaller than a cross sectional area of each of the I-cores.

14. An inverter transformer according to claim 4, wherein the I-cores have a cross sectional area equal to one another, and sides of the frame-core, to which the I-cores are disposed parallel, each have a cross sectional area smaller than a cross sectional area of each of the I-cores.

15. An inverter transformer according to claim 5, wherein the I-cores have a cross sectional area equal to one another, and sides of the frame-core, to which the I-cores are disposed parallel, each have a cross sectional area smaller than a cross sectional area of each of the I-cores.

* * * * *